US007419248B2

(12) United States Patent
Furukawa

(10) Patent No.: US 7,419,248 B2
(45) Date of Patent: Sep. 2, 2008

(54) INK JET HEAD AND INK JET RECORDING APPARATUS

(75) Inventor: Koji Furukawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 315 days.

(21) Appl. No.: 11/028,070

(22) Filed: Jan. 4, 2005

(65) Prior Publication Data

US 2005/0151795 A1 Jul. 14, 2005

(30) Foreign Application Priority Data

Jan. 9, 2004 (JP) ..... 2004-003791

(51) Int. Cl.
*B41J 2/06* (2006.01)

(52) U.S. Cl. ..... 347/55; 347/54; 347/112

(58) Field of Classification Search ..... 347/55, 347/65, 92, 94, 54, 40, 44, 74, 75, 112, 127
See application file for complete search history.

(56) References Cited

U.S. PATENT DOCUMENTS 5,126,768 A * 6/1992 Nozawa et al. ..... 347/65
5,867,181 A * 2/1999 Nakane et al. ..... 347/2
6,092,889 A * 7/2000 Nakamoto et al. ..... 347/55
6,158,844 A * 12/2000 Murakami et al. ..... 347/55
6,286,938 B1 * 9/2001 Okano et al. ..... 347/55
2002/0122099 A1 * 9/2002 Furukawa ..... 347/55

FOREIGN PATENT DOCUMENTS

| | | |
|---|---|---|
| EP | 1 442 886 | 8/2004 |
| JP | 10-138493 A | 5/1998 |
| WO | WO 2004/026582 | 4/2004 |

OTHER PUBLICATIONS

European Search Report dated Feb. 27, 2007.

* cited by examiner

*Primary Examiner*—Matthew Luu
*Assistant Examiner*—Henok Legesse
(74) *Attorney, Agent, or Firm*—Sughrue Mion, PLLC

(57) ABSTRACT

An ink jet head ejects ink by utilizing an electrostatic force to fly the ejected ink towards a recording medium. The ink jet head includes an ejection port substrate having ejection ports bored therethrough, a head substrate disposed at a predetermined distance from the ejection port substrate so as to define an ink flow path between the ejection port substrate and the head substrate, channel separation walls disposed on the head substrate, and ejection electrodes for controlling the ejection of the ink. In this ink jet head, each of the channel separation walls and each of the ejection electrodes are arranged in a position corresponding to each of the ejection ports.

22 Claims, 6 Drawing Sheets

INK JET HEAD AND INK JET RECORDING APPARATUS

This application claims priority on Japanese patent application No. 2004-3791, the entire contents of which are hereby incorporated by reference. In addition, the entire contents of literatures cited in this specification are incorporated by reference.

BACKGROUND OF THE INVENTION

The present invention relates to an ink jet head for ejecting ink to fly the ejected ink towards a recording medium, and an ink jet recording apparatus for recording an image corresponding to image data on a recording medium using the ink jet head.

An ink jet recording apparatus ejects ink from ejection ports to record an image corresponding to image data on a recoding medium. The ink jet recording apparatus, as well known, are classified into an electrostatic ink jet apparatus, a thermal ink jet apparatus, a piezoelectric ink jet apparatus and the like depending on a difference in ejection control means for ink.

Of those ink jet recording apparatus, the electrostatic ink jet recording apparatus uses ink containing charged colorant particles (colored charged particles). Thus, a predetermined voltage is applied to each of ejection portions of an ink jet head in correspondence to image data, thereby generating an electrostatic force in each of the ejection portions thereof, and an image corresponding to the image data is recorded on a recording medium by controlling the ejection of the ink by utilizing the electrostatic forces. As for such an electrostatic ink jet recording apparatus, an ink jet recording apparatus disclosed in JP 10-138493 A is known.

FIG. 7 illustrates a schematic constructional view of an example of the ink jet head of the ink jet recording apparatus disclosed in JP 10-138493 A. In an ink jet head 50 illustrated in FIG. 7, only one ejection portion of an ink jet head disclosed in JP 10-138493 A is conceptually illustrated. The ink jet head 50 includes a head substrate 51, an ink guide 52, an ejection port substrate (insulating substrate) 53, an ejection electrode (control electrode) 54, a counter electrode 55, a D.C. bias voltage source 58, and a pulse voltage source 59.

In the conventional electrostatic ink jet head as illustrated in JP 10-138493 A, the ejection electrode 54 is provided on a surface of the ejection port substrate 53. Hence, when a driving voltage is applied to the ejection electrode 54, an electric field Ed is generated not only from an upper surface of the ejection electrode 54, but also from a lower surface of the ejection electrode 54. That is, the electric field Ed directed from the ejection electrode 54 towards the surface of the head substrate 51 acts on ink Q circulating in an ink flow path 57. The electric field Ed generated in a direction from a lower surface of the ejection electrode 54 to the surface of the head-substrate 51 (hereinafter referred to as "repulsive electric field") acts on colorant particles contained in the ink Q circulating in a main flow path so as to prevent the colorant particles contained therein from flowing into the ejection port (through hole) 56. Thus, when the ink jet head 50 is driven to apply a driving voltage to the ejection electrode 54, the colorant particles are prevented from being concentrated at the ejection port 56, and hence a given period of time is required until the colorant particles are sufficiently concentrated at the ejection port 56. For this reason, when an image is drawn at a high speed using such an ink jet head, there is encountered a problem in that the supply of the colorant particles to the ejection port 56 is impeded by the repulsive electric field generated from the ejection electrode 54 provided on the surface of the ejection port substrate 53, and hence dots each having a desired size cannot be stably formed on a recording medium.

In a case where in the electrostatic ink jet head, a plurality of ejection ports are arranged in matrix to construct a multi channel head, the distribution of wirings among the ejection electrodes of the ejection ports becomes gradually difficult. For this reason, when there are many channels, it is conceivable that the ejection port substrate is structured in the form of a multilayer wiring structure, and in this multilayer wiring structure, the wirings are connected to the ejection electrodes. Thus, when the number of channels is further increased in the future, it is necessary to further thicken the ejection port substrate. However, since if the ejection port substrate is thickened, a length of the ejection port increases as compared with an opening diameter of the ejection port, a resistance generated between the ink and an inner wall of the ejection hole increases so that the ink becomes difficult to be ejected. In addition, if the ejection port substrate is thickened, the ink flowing below the lower surface of the ejection port substrate may stay in the ejection port depending on the flow velocities of the ink. Thus, the ink becomes difficult to be supplied to a tip portion of the ink guide. As a result, a problem occurs in that the responsibility to an ejection frequency becomes poor, and hence as an image drawing frequency increases, the dot diameter becomes gradually small. Moreover, a problem also occurs in that when the ejection ports are integrated at high density along with an increase in the number of channels, a fluid interference with the adjacent channels is caused, and hence the diameters of the dots formed on the recording medium become unstable.

Note that when the ejection port substrate is thickened, that is, the length of the ejection port is increased, in the ink jet recording apparatus using the ink jet heads of the various types as well as in the electrostatic ink jet recording apparatus, the same problems as those of the foregoing arise.

SUMMARY OF THE INVENTION

In the light of foregoing, the present invention has been made in order to solve the above-mentioned problems, and it is, therefore, an object of the present invention to provide an ink jet head which is capable of enhancing a property of supply of ink to an ejection port to stably form dots having a desired size on a recording medium even when ink droplets are continuously ejected at a high speed, and an ink jet recording apparatus using the same.

In order to attain the above-mentioned objects, a first aspect of the present invention provides an ink jet head for ejecting ink by utilizing an electrostatic force to fly the ejected ink towards a recording medium, the ink jet head including: an ejection port substrate having ejection ports bored therethrough, the ink droplet being to be ejected from the ejection ports; a head substrate disposed at a predetermined distance from the ejection port substrate so as to define an ink flow path between the ejection port substrate and the head substrate, the ink flow path supplying the ink to the ejection ports; channel separation walls disposed on the head substrate, each of the channel separation walls being located in a position corresponding to each of the ejection ports; and ejection electrodes for controlling the ejection of the ink, each of the ejection electrodes being located in a position corresponding to each of the ejection ports.

In the ink jet head of the present invention, preferably, each of the channel separation walls is protruded from a surface of the head substrate facing the ejection port substrate.

Preferably, the channel separation walls are protrusion-like portions being protruded from a surface of the head substrate facing the ejection port substrate, and a pair of the protrusion-like portions is disposed in a position corresponding to each of the ejection ports.

Preferably, the pair of protrusion-like portions is provided to mutually face to each other.

Preferably, a spacing between the pair of protrusion-like portions is equal to or wider than an inside diameter of each of the ejection portions.

Preferably, the channel separation walls are formed nearly vertically to a surface of the head substrate facing the ejection port substrate.

Preferably, the ejection electrodes are provided on at least one of a surface of the head substrate facing the ejection port substrate and the channel separation wall.

Preferably, the ink jet head of the present invention further includes a wiring connected to each of the ejection electrodes, the wiring being formed on a surface of the head substrate opposite to a surface of the head substrate facing the ejection substrate.

Preferably, each of the separation walls partially separates the ink flow path to prevent a fluid interference generated by ejection of the ink from adjacent ejection portions.

In order to attain the above-mentioned objects, a second aspect of the present invention provides an ink jet recording apparatus including: an ink jet head for ejecting ink by utilizing an electrostatic force to fly the ejected ink towards a recording medium; and movement means for relatively moving the ink jet head and the recording medium, wherein the ink jet head includes: an ejection port substrate having ejection ports bored therethrough, the ink being to be ejected from the ejection ports; a head substrate disposed at a predetermined distance from the ejection port substrate so as to define an ink flow path between the ejection port substrate and the head substrate, the ink flow path supplying the ink to the ejection ports; channel separation walls disposed on the head substrate, each of the channel separation walls being located in a position corresponding to each of the ejection ports; and ejection electrodes for controlling the ejection of the ink, each of the ejection electrodes being located in a position corresponding to each of the ejection ports.

In the ink jet recording apparatus of present invention, preferably, each of the channel separation walls is protruded from a surface of the head substrate facing the ejection port substrate.

Preferably, the channel separation walls are protrusion-like portions being protruded from a surface of the head substrate facing the ejection port substrate, and a pair of the protrusion-like portions is disposed in the position corresponding to each of the ejection ports.

Preferably, the pair of protrusion-like portions is provided to mutually face to each other.

Preferably, a spacing between the pair of protrusion-like portions is equal to or wider than an inside diameter of each of the ejection portions.

Preferably, the channel separation walls are formed nearly vertically to a surface of the head substrate facing the ejection port substrate.

Preferably, the ejection electrodes are provided on at least one of a surface of the head substrate facing the ejection port substrate and the channel separation wall.

The ink jet recording apparatus of the present invention, preferably, further includes a wiring connected to each of the ejection electrodes, the wiring being formed on a surface of the head substrate opposite to a surface of the head substrate facing the ejection substrate.

Preferably, each of the separation walls partially separates the ink flow path to prevent a fluid interference generated by ejection of the ink from adjacent ejection portions.

Since the ink jet head of the present invention includes the channel separation wall in the position on the head substrate corresponding to the ejection port, even when the ejection ports are integrated at high density along with an increase in the number of channels, it is possible to suppress or prevent the fluid interference generated by the ejection of the ink from the adjacent ejection portions (the adjacent channels). Moreover, it is possible to stabilize the flow of the ink below each ejection portions and to stably supply the ink to each ejection portions. Thus, the dots each having a desired size can be stably formed on the recording medium.

In addition, in the ink jet head of the present invention, the ejection electrode for controlling the ejection of the ink can be provided on at least one of a pair of channel separation walls formed within an ink flow path, and the surface of the head substrate (the surface of the head substrate facing the ejection port substrate). Hence, there is no need to provide the ejection electrode on the ejection port substrate, and as a result, the ejection port substrate can be thinned as compared with the conventional one, and a length (depth) of the ejection port can be made shorter (shallower) than that of the conventional one. For this reason, a resistance generated between the ink and an inner wall of the ejection port can also be reduced, and hence the ink can be speedily ejected from the ejection port. Moreover, the ink is prevented from staying in the ejection port depending on the flow velocities of the ink circulating below the ejection port.

In addition, when the ejection electrode is formed on the surface of the head substrate, the repulsive electric field which is directed from the ejection port substrate towards the ink flow path to impede the supply the colorant particles to the ejection port is not generated, and hence the colorant particles contained in the ink can be speedily supplied to the ejection port. As a result, the responsibility to the ejection frequency in recording of an image is improved, and hence even when the dots are continuously formed at a high speed, the reduction of the dot diameter can be prevented. Hence, the dots each having a desired size can be stably formed. Moreover, since the wiring connected to the ejection electrode can be formed on a back surface of the head substrate (a surface of the head substrate opposite to the surface thereof facing the ejection port substrate), this construction is very advantageous to the high integration of the ejection electrodes accompanying an increase in the number of channels. In addition, since the channels are separated by the channel separation walls, it is possible to suppress the fluid interference with the adjacent channels, and hence the dots each having a desired size can be stably formed.

On the other hand, when the ejection electrode is formed on a pair of channel separation walls, it becomes possible to more efficiently generate the electric field in the ejection port. In addition, since the colorant particles within the ink flow path can be caused to stay below the ejection port by an electrostatic force generated from the ejection electrode formed on a pair of channel separation walls, the concentrated ink can be speedily supplied to the ejection port. Also, the ejection electrode is formed on an upper surface as well of the head substrate held between a pair of channel separation walls, and an electric field is generated from the ejection electrode as well formed on the upper surface of the head substrate, whereby the colorant particles caused to stay below the ejection port can be moved to the ejection port. Hence, the colorant particle supplying property can be further enhanced.

In addition, when no ejection electrode is formed on the ejection port substrate, a signal wiring connected to the ejection electrode can be formed on a back surface of the head substrate (a surface of the head substrate opposite to the surface thereof facing the ejection port substrate). Hence, when a plurality of ejection portions are disposed in matrix to construct the multi channel head, the signal wirings connected to the ejection electrodes of the respective ejection portions can be formed in the form of a multilayer structure on the back surface of the head substrate. Thus, the multi channel head can be realized while the thickness of the ejection port substrate is kept thin.

Since the ink jet recording apparatus of the present invention includes the ink jet head of the present invention, the dots each having a desired size can be stably formed on a recording medium at a high speed, and hence an image of high image quality can be drawn at a high speed.

DETAILED DESCRIPTION OF THE PREFERRED EMBODIMENTS

An ink jet head and an ink jet recording apparatus of the present invention will hereinafter be described in detail based on preferred embodiments illustrated in the accompanying drawings.

Figure 1A:
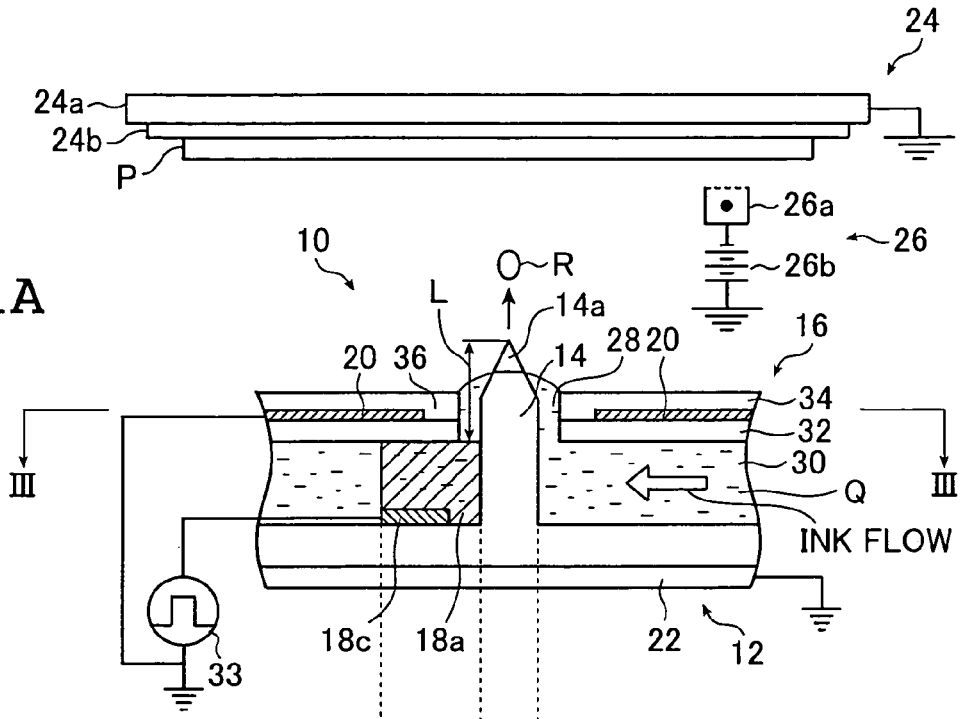
FIG. 1A is a schematic cross-sectional view of an ink jet head according to an embodiment of the present invention.
Figure 1B:
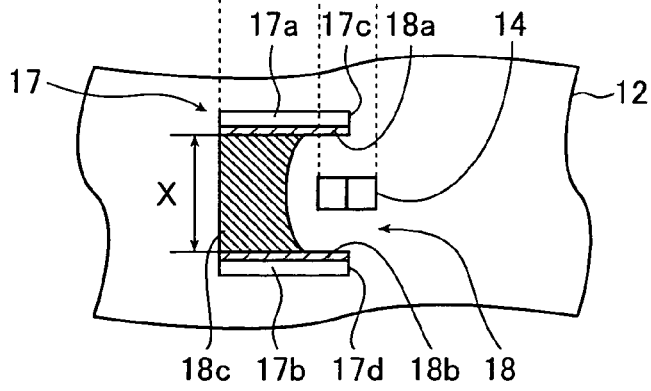
FIG. 1B is a schematic plan view showing a situation when an ejection port substrate of the ink jet head illustrated in FIG. 1A is taken off as viewed from the upper side.

FIG. 1A illustrates a schematic cross-sectional view of an ink jet head according to an embodiment of the present invention, and FIG. 1B illustrates a schematic plan view showing a situation when an ejection port substrate of the ink jet head illustrated in FIG. 1A is taken off as viewed from the upper side. In addition, FIG. 2 illustrates a schematic perspective view of the ink jet head according to the embodiment of the present invention, and FIG. 3 illustrates a cross-sectional view taken along line III-III of FIG. 1A.

Figure 2:
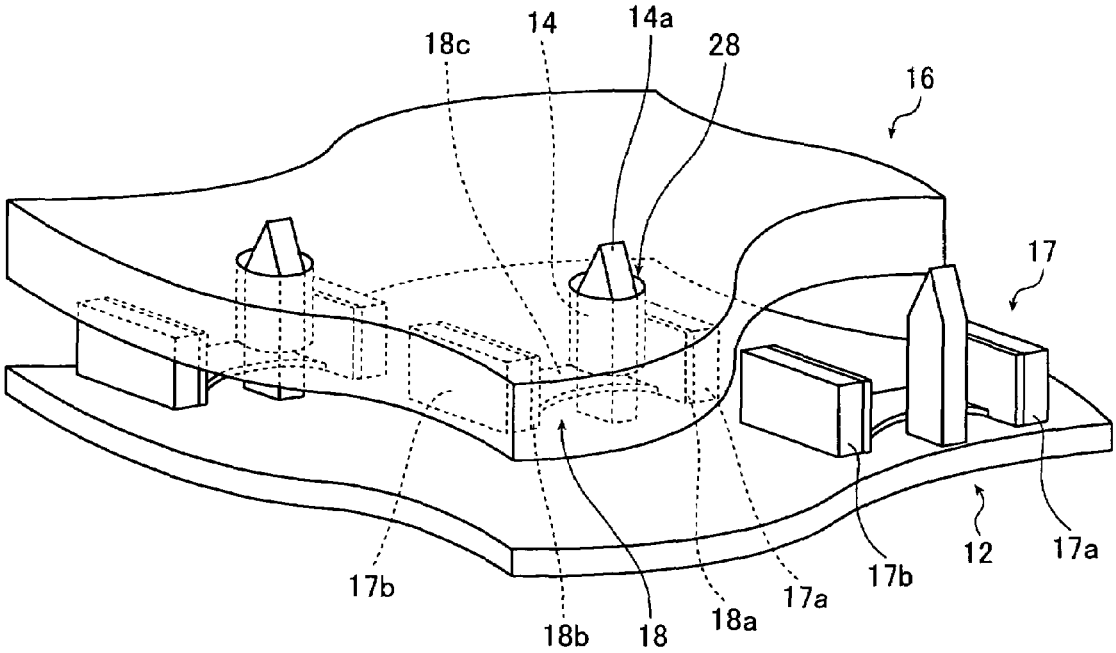
FIG. 2 is a schematic perspective view of the ink jet head according to the embodiment of the present invention.

As illustrated in FIGS. 1A and 2, an electrostatic ink jet head 10 according to an embodiment of the present invention mainly includes a head substrate 12, ink guides 14, and an ejection port substrate (a nozzle substrate) 16 having ejection ports (nozzles) 28. In addition, a counter electrode 24 for supporting a recording medium P and a charging unit 26 for charging the recording medium P with electricity are disposed so as to face a surface of the ink jet head 10 on an ink ejection side (an upper surface of the ink jet head 10 in these figures). Note that in FIG. 2, a guard electrode 20 and a shielding plate 22 which will be described later are not illustrated for the sake of better understanding of the construction.

Figure 3:
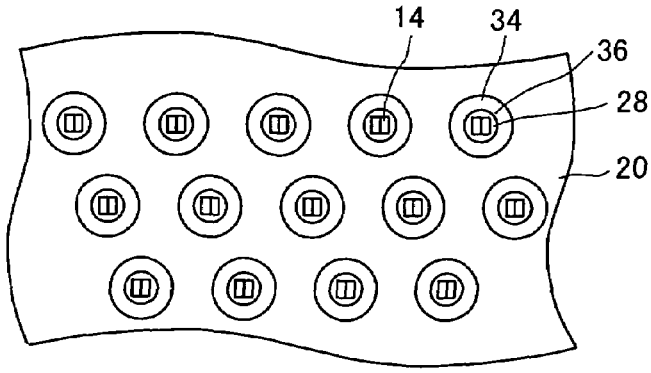
FIG. 3 is a cross-sectional view taken along line III-III of FIG. 1A.

As illustrated in FIG. 3, the ink jet head 10 has a multi channel structure where the ejection portions (nozzles (ejection ports 28)) are arranged two-dimensionally for high density image recording. However, for the sake of clearly representing the structure, FIG. 1A illustrates one ejection portion alone.

In the ink jet head 10 according to the present invention, it is possible to freely choose the number of the ejection electrodes and the physical arrangement thereof. For example, the structure may be the multi channel structure of the embodiment illustrated in FIG. 3 or a structure having only one line of the ejection portions. The ink jet head 10 may be a so-called (full-)line head having lines of ejection portions corresponding to the whole area of the recording medium P or a so-called serial head (shuttle type head) which performs scanning in a direction perpendicular to the nozzle row direction. The ink jet head 10 of the present invention can cope with a monochrome recording apparatus and a color recording apparatus.

The ink jet head 10 described above ejects ink Q prepared by dispersing charged fine particles containing a pigment or other colorant component (hereinafter referred to as colorant particles) into an insulating liquid (carrier liquid) under an electrostatic force. The drive voltage to be applied to the ejection electrode 18 for ejection ON/OFF is controlled in accordance with image data, whereby ink droplets are modulated in accordance with the image data and ejected to record an image on the recording medium P.

As illustrated in FIG. 1A, the head substrate 12 and the ejection port substrate 16 are disposed apart from each other by a predetermined distance, and the gap defined by those substrates 12, 16 forms an main ink flow path 30 for supplying the ink Q to each ejection port 28. The main ink flow path 30 and each ejection port 28 extending to the opening end on the ejection side form an ink flow path. Further, the main ink flow path 30 functions as an ink reservoir (ink chamber) for supplying the ink Q to each ejection port 28 (ink guide 14).

During image recording, the ink Q circulates by an ink circulating mechanism (not illustrated) in a predetermined direction (the ink circulates in the main ink flow path 30 from the right to the left in the illustrated case) at a predetermined speed (for example, at an ink flow rate of 200 mm/s).

As illustrated in FIG. 1A, the ejection port substrate 16 includes an insulating substrate 32, a guard electrode 20, and an insulating layer 34. The guard electrode 20 and the insulating layer 34 are laminated in the stated order on an upper surface of the insulating substrate 32 (a surface of the insulating substrate 32 opposite to a surface thereof facing the head substrate 12).

In addition, the ejection ports 28 for ejecting the ink droplets R is formed while penetrating through the ejection port substrate 16. The ink guide 14 penetrates through each ejection port 28 with its tip end protruding upward. The ejection port substrate 16 having such structure is manufactured, for example, as described below. The guard electrode 20 is formed on an upper surface of an insulating substrate 32 made of an insulating material. The insulating substrate 32 is formed on an upper surface of the guard electrode 20 and part of an upper surface of the insulating substrate 32 to laminate thereon. Then, the ejection ports 28 are bored through the insulating substrate 32 by using a laser beam machine and things like that. In this way, the ejection port substrate 16 having structure as indicated above is manufactured.

Moreover, as illustrated FIGS. 1A and 2, in the ink jet head 10 of the present invention, the ejection electrode 18 is not provided in the ejection port substrate 16. As a result, it is possible to apply the insulating substrate that is thinner than the conventional one to the insulating substrate 32 configuring the ejection port substrate 16. For this reason, a resistance generated between the ink of the ejection port and an inner wall of the ejection port can also be reduced, and hence the ink can be speedily ejected from the ejection port 28. Moreover, the ink is prevented from staying in the ejection ports 28 depending on the flow velocities of the ink circulating below the ejection ports 28.

In the ink jet head 10 of the illustrated embodiment, each ink guide 14 is formed of a ceramic flat plate with a predetermined thickness having a convex tip end portion 14*a*, and disposed on the head substrate 12 for each ejection port 28 (ejection portion). The ink guide 14 passes through the ejection port 28. The tip end portion 14*a* of the ink guide 14 protrudes above the surface of the ejection port substrate 16 on the recording medium P side (surface of the insulating layer 34 on the upper side in the drawing (hereinafter, this side is regarded as upper side and the other side is regarded as lower side)).

In the illustrated embodiment, the ink guide 14 on the tip end portion 14*a* side is processed to be upwardly tapered and to have a substantially triangular shape (or a trapezoidal shape). The shape of the ink guide 14 is not particularly limited as long as the ink Q, more specifically, the charged fine particle component in the ink Q is allowed to pass through the ejection port 28 of the ejection port substrate 16 and to be concentrated at the tip end portion 14*a*. For example, the tip end portion 14*a* is not necessarily convex but the shape may be appropriately changed, and a known shape can be used as well. For example, a notch functioning as an ink guide groove for guiding the ink Q to the tip end portion 14*a* through the capillary phenomenon may be formed in the vertical direction in FIG. 1A in a center portion of the ink guide 14.

A metal is preferably vapor-deposited onto a distal end portion of the ink guide 14. With the vapor-deposition of the metal, the tip end portion 14*a* of the ink guide 14 has practically large permittivity to facilitate generation of an intense electric field, thereby improving ink ejection properties.

As illustrated in FIG. 1A, the shielding plate 22 for shielding electric field noises from the outside is provided on a lower surface of the head substrate 12 (a surface of the head substrate 12 opposite to a surface thereof facing the ejection port substrate 16). The shielding plate 22 is a grounded conductive plate. Thus, by the provision of the shielding plate 22, a bad influence exerted on generation of an electric field in the ejection portion can be excluded, and hence the stable image drawing performance can be maintained.

In addition, as described above, the ink guide 14 is formed nearly vertically to the upper surface of the head substrate 12 in the position, on the upper surface of the head substrate 12, which faces the ejection port 28 (the surface of the head substrate 12 facing the ejection port substrate 16).

As illustrated in FIGS. 1A and 1B, a pair of channel separation walls 17*a* and 17*b* as protrusion-like portions are provided in a position corresponding to each ejection port 28, in the main ink flow path 30 defined by the ejection port substrate 16 and the head substrate 12. The channel separation walls 17*a* and 17*b* are provided on every ejection port. An interval between the channel separation walls 17*a* and 17*b* is set larger than an inner diameter of the ejection port 28. The channel separation walls 17*a* and 17*b*, as a preferable mode, are positioned on a slightly downstream side with respect to the center of the ejection port 28 of the ejection port substrate 16 in a direction of the ink flow (in a longitudinal direction of the channel separation walls 17*a* and 17*b*).

The position of a pair of channel separation walls 17*a* and 17*b* is not especially limited, and hence may be disposed nearly in the same position as that of the center of the ejection port 28 in the direction of the ink flow. In addition, in FIG. 1B, upstream side end portions 17*c* and 17*d* of the channel separation walls 17*a* and 17*b* may be located on a more upstream side with respect to the center of the ejection port 28, or may be located on a more upstream side with respect to an upstream side peripheral portion of the ejection port 28.

In addition, the channel separation walls 17*a* and 17*b* may be disposed in parallel with each other, or may be disposed so as to make a predetermined angle with each other.

In addition, as illustrated in FIG. 1B, an ejection electrode 18 for controlling the ejection of the ink Q is formed in a space defined among the mutually-facing surfaces of the channel separation walls 17*a* and 17*b*, and an upper surface (a bottom surface of the ink flow path) of a portion of the head substrate 12 held between the channel separation walls 17*a* and 17*b*. An upstream side of an ejection electrode element 18*c* on the upper surface of the head substrate 12, as illustrated in FIG. 1B, is formed so as to have a curved shape so as to avoid a base portion of the ink guide 14. The ejection electrode element 18*c* formed on the upper surface of the head substrate 12 has an arbitrary shape, and hence may have a rectangular shape for example.

The ejection electrode 18 is connected to a signal voltage source 33. Upon application of a predetermined voltage from the signal voltage source 33 to the ejection electrode 18, an electric field is generated within the ink flow path held between the channel separation walls 17*a* and 17*b*. Thus, when a predetermined bias voltage is applied to the ejection electrode 18, an electrostatic force can be caused to act on the colorant particles of the ink Q passing through a part of the ink flow path surrounded by the channel separation walls 17*a* and 17*b* to allow the colorant particles to stay within the part of the ink flow path.

Figure 5A:
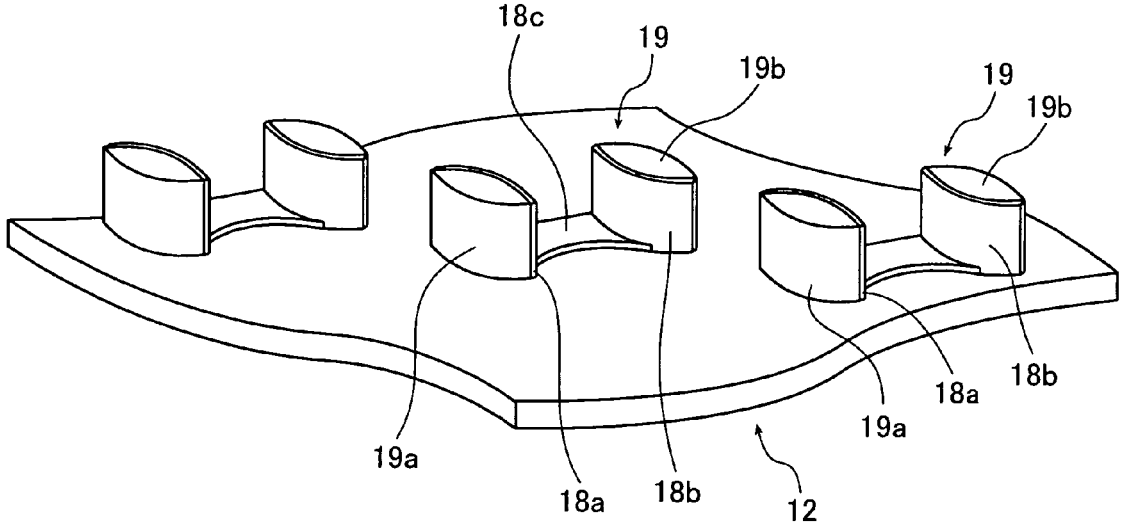
FIG. 5A is a schematic perspective view of a channel separation wall having a streamline shape in which both surfaces of the channel separation wall have curved surface shapes of a channel separation wall according to another embodiment of the present invention.
Figure 5B:
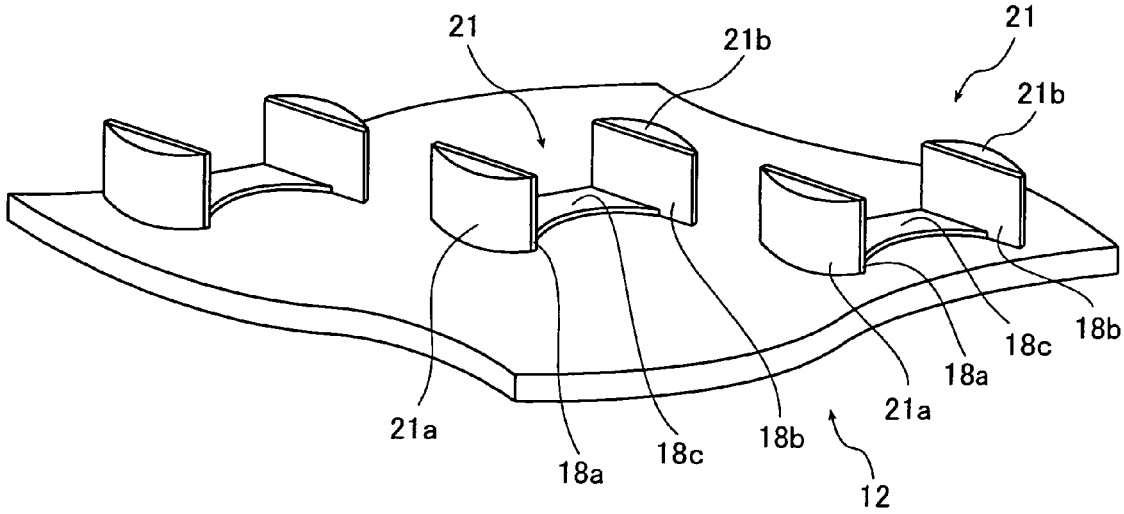
FIG. 5B is a schematic perspective view of a channel separation wall having a streamline shape in which an inner surface of the channel separation wall has a flat surface shape and an outer surface thereof has a curved surface of a channel separation wall according to still another embodiment of the present invention.

In the ink jet head 10 illustrated in FIGS. 1B and 2, each of a pair of channel separation walls 17*a* and 17*b* is formed of a member having a rectangular structure in cross section in a plane parallel to the head substrate 12, that is, a plate-like member having a uniform thickness. However, the present invention is not intended to be limited to such a structure in cross section. For example, each of a pair of channel separation walls 17*a* and 17*b* may adopt a shape in which a thickness of each of a pair of channel separation walls 17*a* and 17*b* becomes thinner towards the end portion thereof in the direction of the ink flow, for example, a streamline shape. Each of the end portions 17*c* and 17*d* of the channel separation walls 17*a* and 17*b* is formed so as to have the streamline shape, whereby when the ink Q flows into the space defined by the channel separation walls 17*a* and 17*b*, a turbulent flow of the ink Q is prevented from being generated in each of the end portions 17*c* and 17*d* of the channel separation walls 17*a* and 17*b*. Thus, each of the end portions 17*c* and 17*d* of the channel separation walls 17*a* and 17*b* may be formed so as to have an arbitrary shape as long as this shape is adapted to prevent the turbulent flow from being generated. For example, as illustrated in FIG. 5A, the channel separation wall may be formed as a channel separation wall 19. In this case, both the mutually-facing surfaces of channel separation walls 19*a* and 19*b*, and surfaces thereof opposite to the mutually-facing surfaces thereof become curved surfaces. In addition, as illustrated in FIG. 5B, the channel separation wall may be formed as a channel separation wall 21. In this case, the mutually-facing surfaces of channel separation walls 21*a* and 21*b* are formed so as to have flat surfaces and the surfaces thereof opposite to the mutually-facing surfaces thereof are formed so as to have curved shapes in which thicknesses of the channel separation walls 21*a* and 21*b* become thinner towards the end portions of the channel separation walls 21*a* and 21*b*. Note that in FIGS. 5A and 5B, only the head substrate 12, the channel separation walls 19 and 21, and the ejection electrode 18 are illustrated for the sake of better understanding of the construction.

In addition, in FIGS. 5A and 5B, each of the end portions of a pair of channel separation walls 19*a* and 19*b* or 21*a* and 21*b* may be formed so as to have a sharpened shape having an acute angle, or may be formed so as to have a curved shape. Alternatively, the upstream side end portion and the downstream side end portion of each of the channel separation walls 19*a* and 19*b* or 21*a* and 21*b* may have shapes different from each other.

In addition, in the illustrated example, the ejection electrode elements 18*a* and 18*b* are formed on the whole surfaces of the mutually-facing surfaces of the channel separation walls 17*a* and 17*b*, respectively. However, the ejection electrode 18 may be formed in any position, for example, in any positions of the channel separation walls 17*a* and 17*b* on upper halves, lower halves, upstream side portions or downstream side portions of the mutually-facing surfaces of the channel separation walls 17*a* and 17*b*. In addition, the ejection electrode elements 18*a* and 18*b* may be formed on the surfaces of the channel separation walls 17*a* and 17*b* opposite to the mutually-facing surfaces thereof.

Further, in the illustrated example, the ejection electrode 18 is formed on the channel separation wall 17 as the preferable mode. In the present invention, the ejection electrode 18 is preferably formed on the channel separation wall 17 and/or on the bottom surface of the ink flow path (the upper surface of the head substrate 12) held between the channel separation walls 17*a* and 17*b*.

In addition, in the ink jet head illustrated in FIGS. 1A and 1B, a pair of channel separation walls 17*a* and 17*b* is disposed so as to contact both the lower surface of the ejection port substrate 16 and the upper surface of the head substrate 12, but may be disposed so as to contact only one of the upper surface of the ejection port substrate 16 and the lower surface of the head substrate 12.

A length of each of the channel separation walls 17*a* and 17*b* is not especially limited. Thus, the channel separation walls 17*a* and 17*b* may be formed in arbitrary length as long as the channel separation walls 17*a* and 17*b* are disposed so as to correspond to the respective ejection ports arranged in matrix.

Figure 4:
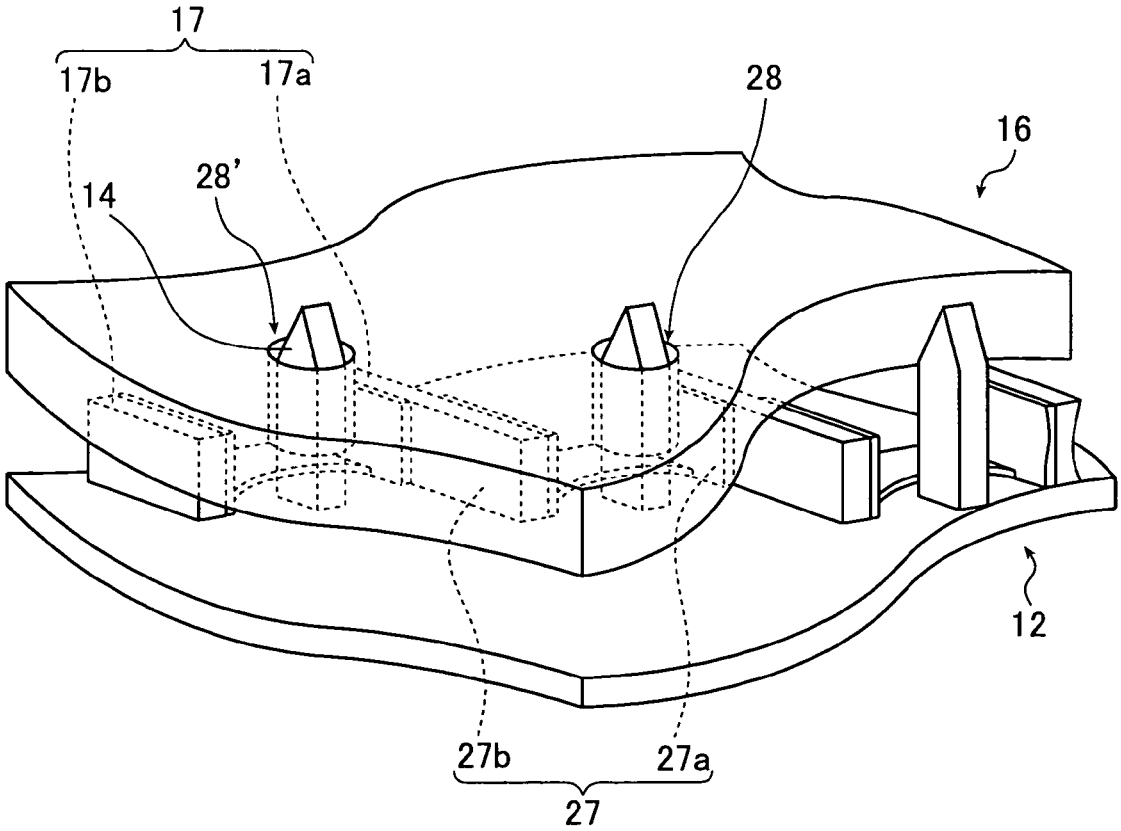
FIG. 4 is a schematic perspective view of an ink jet head of a type in which one of a pair of channel separation walls serves as the other as well of another pair of channel separation walls according to a change of the embodiment of the present invention.

Furthermore, in the illustrated example, a pair of channel separation walls 17*a* and 17*b* is independently formed on every ejection port. However, as illustrated in FIG. 4, the channel separation walls corresponding to the respective ejection ports may be formed so that one channel separation wall 17*a* of a pair of channel separation walls 17 corresponding to the ejection port 28' serves as channel separation wall 27*a* of a pair of channel separation walls 27 corresponding to an ejection port 28 adjacent to the ejection port 28'. Note that in FIG. 4, the illustration of the guard electrode 20 and the shielding electrode 22 is omitted for the sake of better understanding of the construction.

The ink jet head according to this embodiment, as illustrated in FIG. 3, has the multi channel structure in which the ejection ports 28 are two-dimensionally disposed. Hence, the ejection electrodes 18 are similarly two-dimensionally disposed so as to correspond to the respective ejection ports 28. Wirings for connection between the ejection electrodes 18 and the signal voltage source 33, for example, can be formed on a back surface of the head substrate 12 (a surface of the head substrate 12 opposite to a surface thereof facing the ejection port substrate 16). For example, wirings can be readily formed by laminating a layer having the wirings on the back surface of the head substrate 12.

In the present invention, a ratio between an interval between the ejection electrode elements 18*a* and 18*b* which are formed on the mutually-facing surfaces of a pair of channel separation walls 17*a* and 17*b*, respectively, and a distance from the upper surface of each of the ejection electrode elements 18*a* and 18*b* to the tip portion 14*a* of the ink guide 14 is preferably in a range of 1:0.7 to 1:2.8, and more preferably in a range of 1:1.0 to 1:2.4. That is, as illustrated in FIG. 1B, when the interval between the ejection electrode elements 18*a* and 18*b* which are formed on the channel separation walls 17*a* and 17*b*, respectively, is assigned X, and the distance from the upper surface of each of the ejection electrode elements 18*a* and 18*b* and the tip portion 14*a* of the ink guide 14 is assigned L, the interval X between the ejection electrode elements 18*a* and 18*b* and/or the distance L from the upper surface of each of the ejection electrode elements 18*a* and 18*b* to the tip portion 14*a* of the ink guide 14 are preferably adjusted so that the ratio of L/X preferably falls within a range of 0.7 to 2.8, and more preferably falls within a range of 1.0 to 2.4. This is because a range in which the electric field generated by the ejection electrode 18 converges and hence the strongest electric field is formed falls within the above-mentioned range. Thus, the tip portion 14*a* of the ink guide 14 as the ejection portion is disposed in such a position as to meet the above-mentioned range, whereby even when the applied voltage to the ejection electrode 18 is made lower than the conventional one, the ink droplets R can be surely ejected from the tip portion 14*a* of the ink guide 14. That is, the reduction of the applied voltage to the ejection electrode 18 can be realized.

In the ink jet head 10 illustrated in FIG. 1A, the guard electrode 20 is formed in the ejection port substrate 16. The guard electrode 20 is provided in a position closer to the recording medium P than the ejection electrode 18. Thus, the guard electrode 20 is positioned so that electric lines of force generated from the ejection electrode 18 do not reach the tip portion 14*a* of the ink guide 14 which is disposed so as to be close to the ejection port 28 corresponding to that ejection electrode 18. In this embodiment, the guard electrode 20 is formed on the upper surface of the ejection port substrate 16, and its surface is covered with an insulating layer 34. As illustrated in FIG. 3, the guard electrode 20 is a sheet-like electrode such as a metallic plate which is common to the ejection electrodes 18. Also, opening portions 36 corresponding to the respective ejection ports 28 which are two-dimensionally disposed are formed in the guard electrode 20.

The guard electrode 20 can shield the electric lines of force in the adjacent ejection electrodes 18 to suppress the electric field interference between the adjacent ejection electrodes 18. A predetermined voltage (including 0 V by grounding) is applied to the guard electrode 20. In the embodiment illustrated in FIG. 1A, the guard electrode 20 is grounded and hence has 0 V as the applied voltage.

Here, the guard electrode 20 needs to be provided so as to shield the electric lines of force from other ejection electrodes 18 and the electric lines of force to the tip portions 14*a* of the ink guides 14 disposed in the other ejection ports 28 (hereinafter referred to as "other channels" for the sake of convenience) while ensuring the electric lines of force acting on the tip portion 14*a* of the ink guide 14 disposed in the ejection port 28 corresponding to the ejection electrode 18 (hereinafter referred to as "an own-channel" for the sake of convenience) of the electric lines of force generated from that ejection electrode 18.

Taking the above-mentioned respects into consideration, the diameter of the opening portion 36 of the guard electrode 20 is preferably set so as not to interrupt a projected line from the ejection electrode 18 to the own-channel, but to interrupt a projected line from the ejection electrode 18 to the other channels in correspondence to the disposed ejection electrode 18.

With the above-mentioned construction, after the stability of the ink ejection from the ejection port 28 is sufficiently ensured, the dispersion or the like in the ink sticking positions due to the electric field interference between the adjacent channels can be suitably suppressed to stably record an image of high image quality on the recording medium P.

While in the embodiment as described above, the sheet-like electrode is used as the guard electrode 20, the present invention is not intended to be limited to this construction. Thus, the guard electrode 20 may be constructed in any suitable manner as long as the guard electrode 20 is provided so as to be able to shield the electric lines of force from the other channels among the ejection portions. For example, the guard electrode 20 may be provided in the form of a mesh among the ejection portions. Alternatively, the guard electrode 20 may not be provided in a portion in which the ejection portions are sufficiently separated so as to be free from the electric field interference, but may be provided only among the ejection portions close to each other.

As described above, in FIG. 1A, the counter electrode 24 is disposed so as to face the surface of the ink jet head 10 from which the ink droplets R are to be ejected.

The counter electrode 24 is disposed in a position facing the tip portion 14*a* of the ink guide 14, and includes an electrode substrate 24*a* which is grounded and the insulating sheet 24*b* which is disposed on a lower surface of the electrode substrate 24*a* in the figure, that is, on a surface of the electrode substrate 24*a* on the side of the ink jet head 10.

The recording medium P is supported on the lower surface of the counter electrode 24 in the figure, that is, on the surface of the insulating sheet 24*b* by an electrostatic attraction for example. The counter electrode 24 (the insulating sheet 24*b*) functions as a platen for the recording medium P.

The recording medium P held on the insulating sheet 24*b* of the counter electrode 24, at least in recording of an image, is charged to a predetermined negative high voltage having a polarity opposite to that of the driving voltage (for example, the pulse voltage) applied to the ejection electrode 18, e.g., −1.5 kV by the charge unit 26.

As a result, the recording medium P is charged negative to be biased to the negative high voltage to function as the substantial counter electrode to the ejection electrode 18, and is electrostatic attracted on the insulating sheet 24*b* of the counter electrode 24.

The charge unit 26 includes a scorotron charger 26*a* for charging the recording medium P to a negative high voltage, and a bias voltage source 26*b* for supplying a negative high voltage to the scorotron charger 26*a*. Note that the charge means of the charge unit 26 used in the present invention is not limited to the scorotron charger 26*a*, and hence the various discharge means such as a corotron charger, a solid state charger and a discharge needle can be used.

In addition, in the illustrated embodiment, the counter electrode 24 is constituted by the electrode substrate 24*a* and the insulating sheet 24*b*, and the recording medium P is charged to the negative high voltage by the charge unit 26 to be caused to function as the counter electrode to the ejection electrode 18 by applying thereto the bias voltage and also to be electrostatic attracted on the surface of the insulating sheet 24*b*. However, the present invention is not intended to be limited to this construction. That is, there may also be adapted such a construction that the counter electrode 24 is constituted by only the electrode substrate 24*a*, the counter electrode 24 (the electrode substrate 24*a* itself) is connected to a bias voltage source for supplying a negative high voltage to be usually biased to the negative high voltage, and the recording medium P is electrostatic attracted on the surface of the counter electrode 24.

Further, the electrostatic attraction of the recording medium P on the counter electrode 24, the charge of the recording medium P to the negative high voltage, and the application of the negative high bias voltage to the counter electrode 24 may be performed using respective negative high voltage sources. Also, the support of the recording medium P by the counter electrode 24 is not limited to the utilization of the electrostatic attraction of the recording medium P, and hence any other supporting method or supporting means may be used for the support of the recording medium P by the counter electrode 24.

Hereinafter, the present invention will be described in greater detail by reference to the ejection operation for the ink droplets R in the ink jet head 10.

As illustrated in FIG. 1A, upon recording, the ink Q containing colorant particles charged to the same polarity as that of the voltage to be applied to the ejection electrode 18, for example positively charged colorant particles is circulated by the ink circulating mechanism including a pump (not illustrated) in a direction illustrated by an arrow (from the right to the left in FIG. 1A) in the main ink flow path 30 of the ink jet head 10.

On the other hand, the recording medium P on which an image is to be recorded is charged to have the polarity opposite to that of the colorant particles, that is, a negative high voltage (for example, −1500 V) by the charge unit 26. While being charged to the bias voltage, the recording medium P is attracted to the counter electrode 24. A shield plate 22 is grounded.

In this state, the recording medium P (counter electrode 24) and the ink jet head 10 are moved relatively while a signal voltage source 33 applies a drive voltage (pulse voltage) to each ejection electrode 18 in accordance with supplied image data. Ejection ON/OFF is controlled depending on whether or not the drive voltage is applied, whereby the ink droplets R are modulated in accordance with the image data and ejected to record an image on the recording medium P.

Here, when the drive voltage is not applied to the ejection electrode 18 (or the applied voltage is at a low voltage level), i.e., in a state where the bias voltage is only applied, Coulomb attraction between the bias voltage and the charge of the colorant particles (charged particles) of the ink Q, Coulomb repulsive force between the colorant particles, viscosity, surface tension, and dielectric polarization force of the carrier liquid, and the like act on the ink Q. Owing to the combination of those, the colorant particles and the carrier liquid move, and as schematically illustrated in FIG. 1A, the meniscus of the ink Q in the ejection port 28 is slightly raised from the level of the ejection port 28 to thereby obtain a balance.

Furthermore, with this Coulomb attraction and the like, the colorant particles move toward the recording medium P charged to the bias voltage due to so-called electrophoresis. To elaborate, the ink Q is condensed in the meniscus of the ejection port 28.

From this state, the drive voltage is applied to the ejection electrode 18. Accordingly, the drive voltage is superposed on the bias voltage, and movement occurs due to further combination of the drive voltage superposition and the above-mentioned combination. The colorant particles and the carrier liquid are attracted to the bias voltage (counter electrode) side, that is, the recording medium P side, by the electrostatic force. The above meniscus then grows to have a substantially conical ink liquid column so-called Taylor cone, formed from the above. Also, similar to the above, the colorant particles move toward the meniscus due to the electrophoresis, and the ink Q of the meniscus is therefore condensed to contain a large number of the colorant particles and achieves substantially uniform high concentration state.

After starting the application of the drive voltage, when a limited period of time elapses, the movement of the colorant particles or the like at the tip end of the meniscus having high electric field intensity causes unbalanced surface tension mainly between the colorant particles and the carrier liquid, and the meniscus dramatically extends to form an elongated ink liquid column called "string" having about several μm to several tens of μm in diameter.

As a limited period of time further elapses, the string grows. The interaction of the growth of this string, vibration due to Rayleigh-Weber instability, nonuniform distribution of the colorant particles in the meniscus, nonuniform distribution of electrostatic field acting on the meniscus, and the like separates the string to form the ink droplets R to be ejected/flown. Also, the ink droplets R are attracted owing to the bias voltage to the recording medium P. It should be noted that the growth and separation of the string and further the movement of the colorant particles to the meniscus (string) are generated in succession during the drive voltage application.

After the end of the application of the drive voltage (ejection is OFF), the meniscus returns to the above-mentioned state where only the bias voltage is applied.

Here, in the ink jet head 10 of the present invention, the ejection electrode 18 is exposed to the main ink flow path 30, that is, contacts the ink Q in the main ink flow path 30.

Thus, when the driving voltage is applied to the ejection electrode 18 contacting the ink Q in the main ink flow path 30 and the ink flow path formed in the ejection port 28 (up to its opening end portion) (the ejection is ON), a part of the electric charge supplied to the ejection electrode 18 is injected into the ink Q, and hence a conductivity of the ink Q located in the space defined by the ejection port 28 and the ejection electrode 18 increases. In addition, the charged colorant particles floating in the ink Q flowing from the upstream side are caused to stay in the region below the ejection portion 28 and are then pushed up towards the ejection port 28 by the electrostatic force generated from the ejection electrode 18 formed on the channel separation wall 17 and the upper surface of the head substrate 12 (the bottom surface of the ink flow path). As a result, in the ink jet head 10 of the present invention, only when the driving voltage is applied to the ejection electrode 18 (only when the ejection is ON), a state is provided in which the ink Q becomes easy to be remarkably ejected in the form of the ink droplets R (the ink ejection property is enhanced).

In the electrostatic ink jet head having the construction as described above, even when the driving voltage applied to the ejection electrode 18 in order to eject the ink droplets R is made much smaller than the conventional one, the ink droplets R can be stably ejected. According to our investigation, as an example, though the driving voltage of 1,000 V was required when the bias voltage was −1,500 V in the conventional electrostatic ink jet head, according to the electrostatic ink jet head having the construction as described above, the ink droplets R could be stably ejected with the driving voltage of about 400 V. Consequently, according to the electrostatic ink jet head described in this embodiment, the ejection ON/OFF of the ink droplets can be stably controlled using the inexpensive power supply in accordance with ON/OFF of the low driving voltage.

In addition, the enhancement of the ejection property results in that even when the bias voltage applied to the recording medium P (the counter electrode 24) is reduced and/or the ink having a low ejection property (for example, the ink having a low conductivity) is used, the sufficient ejection property of the ink droplets R when the ejection is ON is ensured without increasing the driving voltage, and the stable ejection can be performed. That is, after the ejection property when the ejection is ON is ensured, the ejection property when the ejection is OFF can be reduced. Consequently, according to the present invention, a difference in ejection property between when the ejection is ON and when the ejection is OFF is greatly increased as compared with the conventional case so that more stable ejection of the ink droplets R can be achieved.

Moreover, according to the present invention, since the driving voltage can be reduced, the electric field interference between the adjacent ejection electrodes 18 can also be reduced. Furthermore, according to the above-mentioned construction, it is also possible to prevent the short-circuit and the discharge between the ejection electrode 18 and the guard electrode 20 due to the filming or the like of the colorant particles of the ink Q.

Next, ink used in the ink jet head of the present invention will be described.

The ink Q (ink composition) used in the ink jet head 10 described above is obtained by dispersing charged fine particles which contain colorants (hereinafter referred to as colorant particles) in a carrier liquid.

The carrier liquid is preferably a dielectric liquid (non-aqueous solvent) having a high electrical resistivity (equal to or larger than $10^9$ Ω·cm, and more preferably equal to or larger than $10^{10}$ Ω·cm). If the electrical resistivity of the carrier liquid is low, the concentration of the colorant particles does not occur since the carrier liquid itself receives the injection of the electric charges to be charged due to a drive voltage applied to the ejection electrodes. In addition, since there is also anxiety that the carrier liquid having a low electrical resistivity causes the electrical conduction between the adjacent ejection portions, the carrier liquid having a low electrical resistivity is unsuitable for the present invention.

A relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colorant particles contained in the carrier liquid to facilitate the electrophoresis of the colorant particles.

Note that an upper limit of the specific electrical resistance of such a carrier liquid is desirably about $10^{16}$ Ω·cm, and a lower limit of the relative permittivity is desirably about 1.9. The reason why the electrical resistance of the carrier liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as a carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid. Alternatively, the colorant particles may also be contained in dispersion resin particles for enhancement of fixing property. In the case where the colorants are contained in the dispersion resin particles, in general, there is adopted a method in which the pigments or the like are covered with the resin material of the dispersion resin particles to obtain the particles covered with the resin, or the dispersion resin particles are colored with the dyes or the like to obtain the colored particles.

As the colorants, all the ink composition for ink jet recording, the (oily) ink composition for printing, or the pigments and dyes used in the liquid developer for electrostatic photography may be used as in the past.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of dispersion resin particles include rosins, rosin-modified phenol resin, alkyd resin, a (meta)acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, a content of colorant particles (a total content of colorant particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colorant particles decreases, the following problems become easy to arise. The density of the printed image is insufficient, the affinity between the ink Q and the surface of the recording medium P becomes difficult to obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink Q is easy to occur in the ink jet head or the like to make it difficult to obtain the stable ink ejection, and so forth.

In addition, an average particle diameter of the colorant particles dispersed in the carrier liquid preferably falls within a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the colorant particles are dispersed in the carrier liquid and optionally a dispersing agent, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes.

In addition, a charging amount of colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, a distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where $\sigma 1$ is an electric conductivity of the ink Q, and $\sigma 2$ is an electric conductivity of a supernatant liquid which is obtained by inspecting the ink Q with a centrifugal separator. Those electric conductivities were obtained by measuring the electric conductivities of the ink Q and the supernatant liquid under a condition of an applied voltage of 5 V and a frequency of 1 kHz using an LCR meter of an AG-4311 type (manufactured by ANDO ELECTRIC CO., LTD.) and electrode for liquid of an LP-05 type (manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent ejection electrodes.

In addition, a surface tension of the ink Q is preferably in a range of 15 to 50 mN/m, more preferably in a range of 15.5 to 45.0 mN/m, and much more preferably in a range of 16 to 40 mN/m. The surface tension is set in this range, resulting in that the applied voltages to the ejection electrodes are not excessively high, and also the ink does not leak or spread to the periphery of the head to contaminate the head.

Moreover, a viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to the dispersion medium to allow the colorant particles to be charged. The following methods are given as the specific methods.

(1) A method including: previously mixing (kneading) a colorant and/or dispersion resin particles; dispersing the resultant mixture into a carrier liquid using a dispersing agent when necessary; and adding the charging control agent thereto.

(2) A method including: adding a colorant and/or dispersion resin particles and a dispersing agent into a carrier liquid at the same time for dispersion; and adding the charging control agent thereto.

(3) A method including adding a colorant and the charging control agent and/or the dispersion resin particles and the dispersing agent into a carrier liquid at the same time for dispersion.

Note that, in the present invention, there is not adopted the process in which a force is caused to act on the overall ink to fly the ink towards the recording medium as in a conventional ink jet system, but there is adopted the process in which a force is caused to mainly act on the colorant particles as the solid components dispersed into the carrier liquid to fly the ink droplets each containing the colorant particles to the recording medium P.

As a result, an image can be recorded on various recording media P such as a non-absorption film (such as a PET film) as well as plain paper. In addition, a high-quality image can be obtained on the various recording media without causing bleeding or flowing on the recording medium P.

Figure 6A:
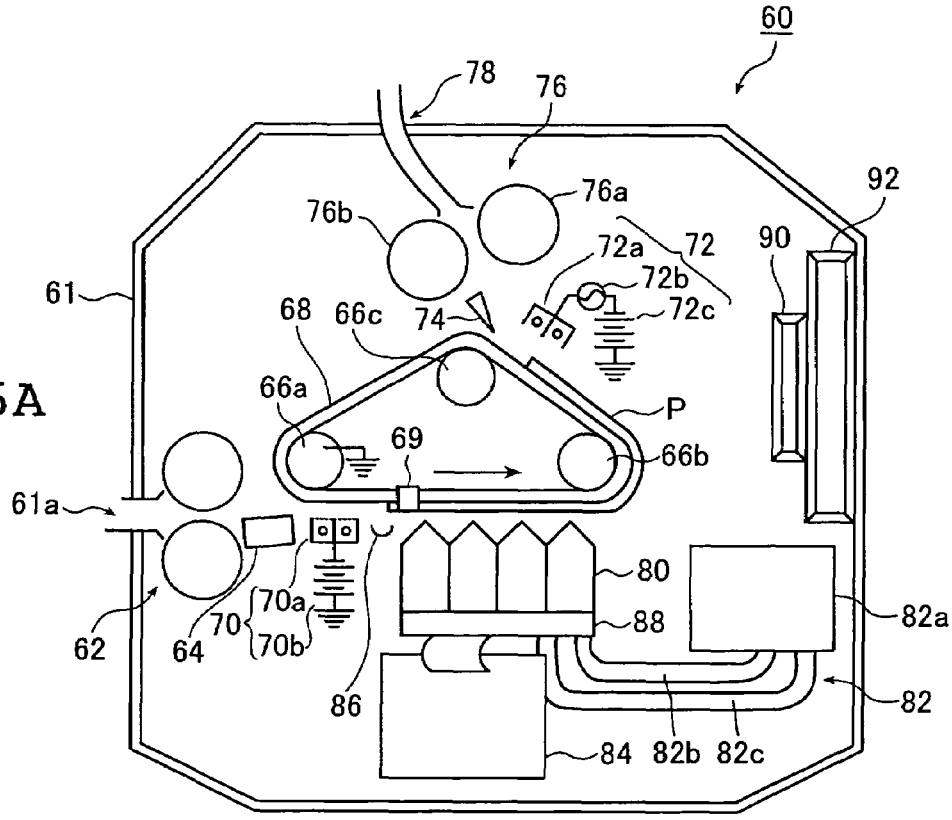
FIG. 6A is a schematic cross-sectional view of an ink jet recording apparatus according to an embodiment of the present invention.

FIG. 6A is a conceptual diagram of an embodiment of an ink jet recording apparatus of the present invention which utilizes the ink jet head of the present invention.

An ink jet recording apparatus 60 (hereinafter, referred to as printer 60) illustrated in FIG. 6A is an apparatus for performing four-color one-side printing on the recording medium P. The printer includes conveyor means for the recording medium P, image recording means, and solvent collecting means, all of which are accommodated in a casing 61.

The conveyor means includes a feed roller pair 62, a guide 64, rollers 66 (66*a*, 66*b*, and 66*c*), a conveyor belt 68, conveyor belt position detecting means 69, electrostatic attraction means 70, discharge means 72, peeling means 74, fixation/conveyance means 76, and a guide 78. The image recording means includes a head unit 80, an ink circulating system 82, a head driver 84 and recording medium position detecting means 86. The solvent collecting means includes a discharge fan 90, and a solvent collecting device 92.

In the conveyor means for the recording medium P, the feed roller pair 62 is a conveyance roller pair disposed in the vicinity of a feeding port 61*a* provided on a side surface of the casing 61. The feed roller pair 62 feeds the recording medium P fed from a paper cassette (not illustrated) to the conveyor belt 68 (a portion supported by the roller 66*a* in FIG. 6A). The guide 64 is disposed between the feed roller pair 62 and the roller 66*a* for supporting the conveyor belt 68 and guides the recording medium P fed by the feed roller pair 62 to the conveyor belt 68.

Foreign matter removal means for removing foreign matter such as dust or paper powder adhered to the recording medium P is preferably disposed in the vicinity of the feed roller pair 62.

As the foreign matter removal means, one or more of known methods including non-contact removal methods such as suction removal, blowing removal and electrostatic removal, and contact removal methods such as removal using a blush, a roller, etc., may be used in combination. It is also possible that the feed roller pair 62 is composed of a slightly adhesive roller, a cleaner is prepared for the feed roller pair 62, and foreign matter such as dust or paper powder is removed when the feed roller pair 62 feeds the recording medium P.

The conveyor belt 68 is an endless belt extended over the three rollers 66 (66*a*, 66*b*, and 66*c*). At least one of the rollers 66*a*, 66*b*, and 66*c* is connected to a drive source (not illustrated) to rotate the conveyor belt 68.

At the time of image recording by the head unit 80, the conveyor belt 68 functions as scanning conveyor means for the recording medium P and also as a platen for holding the recording medium P. After the end of image recording, the conveyor belt 68 further conveys the recording medium P to the fixation/conveyance means 76. Therefore, the conveyor belt 68 is preferably made of a material which is excellent in dimension stability and has durability. The conveyor belt 68 is for example made of a metal, a polyimide resin, a fluororesin, another resin, or a complex thereof.

In the illustrated embodiment, the recording medium P is held on the conveyor belt 68 under electrostatic attraction. In correspondence with this, the conveyor belt 68 has insulating properties on a side on which the recording medium P is held (front face), and conductive properties on the other side on which the belt 68 contacts the rollers 66 (rear face). Further, in the illustrated embodiment, the roller 66*a* is a conductive roller, and the rear face of the conveyor belt 68 is grounded via the roller 66*a*.

The conveyor belt 68 also functions as the counter electrode 24 including the electrode substrate 24*a* and the insulating sheet 24*b* illustrated in FIG. 1A when the conveyor belt 68 holds the recording medium P.

A belt having a metal layer and an insulating material layer manufactured by a variety of methods, such as a metal belt coated with a resin material, for example, fluoroplastic on the front face, a belt obtained by bonding a resin sheet to a metal belt with an adhesive or the like, and a belt obtained by vapor-depositing a metal on the rear face of a belt made of the above-mentioned resin may be used as the conveyor belt 68.

The conveyor belt 68 preferably has the flat front face contacting the recording medium P, whereby satisfactory attraction properties of the recording medium P can be obtained.

Meandering of the conveyor belt 68 is preferably suppressed by a known method. An example of a meandering suppression method is that the roller 66*c* is composed of a tension roller, a shaft of the roller 66*c* is inclined with respect to shafts of the rollers 66*a* and 66*b* in response to an output of the conveyor belt position detecting means 69, that is, a position of the conveyor belt 68 detected in a width direction, thereby changing a tension at both ends of the conveyor belt in the width direction to suppress the meandering. The rollers 66 may have a taper shape, a crown shape, or another shape to suppress the meandering.

The conveyor belt position detecting means 69 suppresses the meandering of the conveyor belt etc. in the above manner and detects the position of the conveyor belt 68 in the width direction to regulate the recording medium P to situate at a predetermined position in the scanning/conveyance direction at the time of image recording. Known detecting means such as a photo sensor may be used.

The electrostatic attraction means 70 charges the recording medium P to a predetermined bias voltage with respect to the head unit 80 (ink jet head of the present invention), and charges the recording medium P to have a predetermined potential such that the recording medium P is attracted and held on the conveyor belt 68 under an electrostatic force.

In the illustrated embodiment, the electrostatic attraction means 70 includes a scorotron charger 70*a* for charging the recording medium P and a negative high voltage power source 70*b* connected to the scorotron charger 70. While being conveyed by the feed roller pair 62 and the conveyor belt 68, the recording medium P is charged to a negative bias voltage by the scorotron charger 70*a* connected to the negative high voltage power source 70*b* and attracted to the insulating layer of the conveyor belt 68.

Note that a conveying speed of the conveyor belt 68 when charging the recording medium P may be in a range where the charging is performed with stability, so the speed may be the same as, or different from, a conveying speed at the time of image recording. Also, the electrostatic attraction means may act on the same recording medium P several times by circulating the recording medium P several times on the conveyor belt 68 for uniform charging.

In the illustrated embodiment, the electrostatic attraction and the charging for the recording medium P are performed in the electrostatic attraction means 70, but the electrostatic attraction means and the charging means may be provided separately.

The electrostatic attraction means is not limited to the scorotron charger 70*a* of the illustrated embodiment; a corotron charger, a solid-state charger, an electrostatic discharge needle, and various means and methods can be employed. As will be described in detail later, at least one of the rollers 66 is composed of a conductive roller, or a conductive platen is disposed on the rear side of the conveyor belt 68 in a recording position for the recording medium P (side opposite to the recording medium P). Then, the conductive roller or the conductive platen is connected to the negative high voltage power source, thereby forming the electrostatic attraction means 70. Alternatively, it is also possible that the conveyor belt 68 is composed of an insulating belt and the conductive roller is grounded to connect the conductive platen to the negative high voltage power source.

The conveyor belt 68 conveys the recording medium P charged by the electrostatic attraction means 70 to the position where the head unit 80 to be described later is located.

The head unit 80 uses the ink jet head of the present invention to eject ink droplets in accordance with image data to thereby record an image on the recording medium P. As described above, the ink jet head of the present invention uses a charge potential of the recording medium P for the bias voltage and applies a drive voltage to the ejection electrodes 18, whereby the drive voltage is superposed on the bias voltage and the ink droplets R are ejected to record an image on the recording medium P. At this time, the conveyor belt 68 is provided with heating means to increase a temperature of the recording medium P, thus promoting fixation of the ink droplets R on the recording medium P and further suppressing ink bleeding, which leads to improvement in image quality.

Image recording using the head unit 80 and the like will be described in detail below.

The recording medium P on which the image is formed is discharged by the discharge means 72 and peeled off the conveyor belt 68 by the peeling means 74 before being conveyed to the fixation/conveyance means 76.

In the illustrated embodiment, the discharge means 72 is a so-called AC corotron discharger, which includes a corotron discharger 72*a*, an AC power source 72*b*, and a DC high voltage power source 72*c* with one end grounded. In addition thereto, various means and methods, for example, a scorotron discharger, a solid-state discharger, and an electrostatic discharge needle can be used for discharge. Also, as in the electrostatic attraction means 70 described above, a structure using a conductive roller or a conductive platen can also be preferably utilized.

A known technique using a peeling blade, a counter-rotating roller, an air knife or the like is applicable to the peeling means 74.

The recording medium P peeled off the conveyor belt 68 is sent to the fixation/conveyance means 76 where the image formed by means of the ink jet recording is fixed. A pair of rollers composed of a heat roller 76*a* and a conveying roller 76*b* is used as the fixation/conveyance means 76 to heat and fix the recorded image while nipping and conveying the recording medium P.

The recording medium P on which the image is fixed is guided by the guide 78 and delivered to a delivered paper tray (not illustrated).

In addition to the heat roll fixation described above, examples of the heat fixation means include irradiation with infrared rays or using a halogen lamp or a xenon flash lamp, and general heat fixation such as hot air fixation using a heater. Further, in the fixation/conveyance means 76, it is also possible that the heating means is used only for heating, and the conveyance means and the heat fixation means are provided separately.

It should be noted that in the case of heat fixation, when a sheet of coated paper or laminated paper is used as the recording medium P, there is a possibility of causing a phenomenon called "blister" in which irregularities are formed on the sheet surface since moisture inside the sheet abruptly evaporates due to rapid temperature increase. To avoid this, it is preferable that a plurality of fixing devices be arranged, and at least one of power supply to the respective fixing devices and a distance from the respective fixing devices to the recording medium P be changed such that the temperature of the recording medium P gradually increases.

The printer 60 is preferably constructed such that no components will contact the image recording surface of the recording medium P at least during a time from the image recording with the head unit 80 until the completion of fixation with the fixation/conveyance means 76.

Further, the movement speed of the recording medium P at the time of fixation with the fixation/conveyance means 76 is not particularly limited, which may be the same as, or different from, the conveying speed by the conveyor belt 68 at the time of image formation. When the movement speed is different from the conveying speed at the time of image formation, it is also preferable to provide a speed buffer for the recording medium P immediately before the fixation/conveyance means 76.

Image recording using the printer 60 will be described below in detail.

As described above, the image recording means of the printer 60 includes the head unit 80 for ejecting ink, the ink circulation system 82 that supplies the ink Q to the head unit 80 and recovers the ink Q from the head unit 80, the head driver 84 that drives the head unit 80 based on an output image signal from a not-illustrated external apparatus such as a computer or a raster image processor (RIP), and the recording medium position detection means 86 for detecting the recording medium P in order to determine an image recording position on the recording medium P.

Figure 6B:
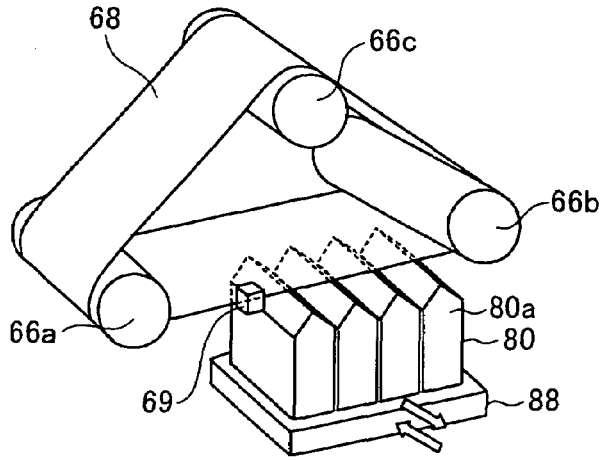
FIG. 6B is a perspective view schematically illustrating a head unit and conveyance means for conveying a recording medium provided in a periphery of the head unit.
Figure 7:
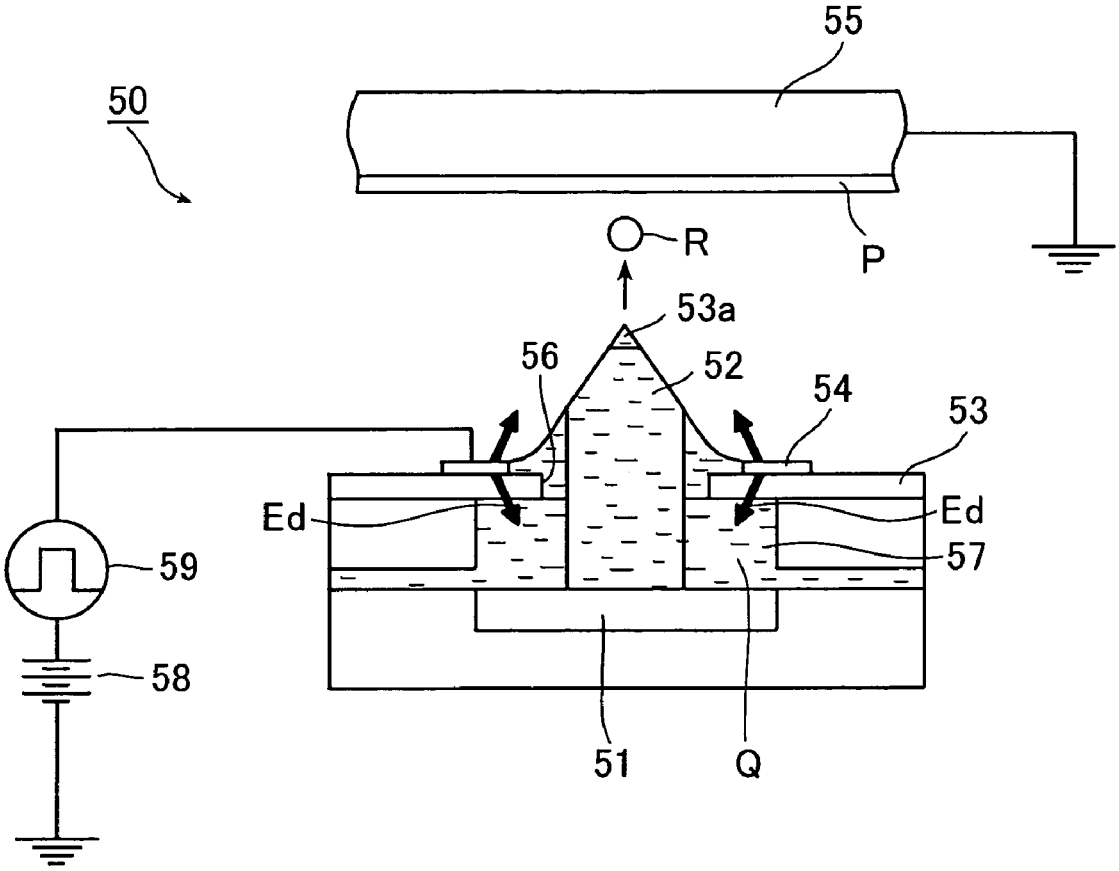
FIG. 7 PRIOR ART
FIG. 7 is a schematic cross-sectional view of a conventional ink jet head.

FIG. 6B is a schematic perspective view showing the head unit 80 and the conveyor means for the recording medium P on the periphery thereof.

The head unit 80 includes four ink jet heads 80*a* for four colors of cyan (C), magenta (M), yellow (Y), and black (K) for recording a full-color image, and records an image on the recording medium P transported by the conveyor belt 68 at a predetermined speed by ejecting the ink Q supplied by the ink circulation system 82 as ink droplets R in accordance with signals from the head driver 84 to which image data was supplied. The ink jet heads 80*a* for the respective colors are arranged along a traveling direction of the conveyor belt 68.

Note that the ink jet head 80*a* for each color in the head unit 80 is the ink jet head of the present invention.

In the illustrated embodiment, each of the ink jet heads 80*a* is a line head including ink ejection ports 28 disposed in the entire area in the width direction of the recording medium P. The ink jet head 80*a* is preferably a multi-channel head as illustrated in FIG. 3, which has multiple nozzle lines, arranged in a staggered shape.

Therefore, in the illustrated embodiment, while the recording medium P is held on the conveyor belt 68, the recording medium P is conveyed to pass over the head unit 80 once. In other words, scanning and conveyance are performed only once for the head unit 80. Then, an image is formed on the entire surface of the recording medium P. Therefore, image recording (drawing) at a higher speed is possible compared to serial scanning of the ejection head.

Note that the ink jet head of the present invention is also applicable to a so-called serial head (shuttle type), and therefore the printer 60 may take this configuration.

In this case, the head unit 80 is structured such that a line (which may have a single line or multi channel structure) of the ejection ports 28 for each ink jet head agrees with the conveying direction of the conveyor belt 68, and the head unit 80 is provided with known scanning means which scans the head unit 80 in a direction perpendicular to the direction in which the recording medium P is conveyed.

Image recording may be performed as in a usual shuttle type ink jet recording printer. In accordance with a length of the line of the ejection ports 28, the recording medium P is conveyed intermittently by the conveyor belt 68, and in synchronization with this intermittent conveying, the head unit 80 is scanned when the recording medium is at rest, whereby an image is formed on the entire surface of the recording medium P.

As described above, the image formed by the head unit 80 on the entire surface of the recording medium P is then fixed by the fixation/conveyance means 76 while the recording medium P is nipped and conveyed by the fixation/conveyance means 76.

The head driver 84 receives image data from a system control portion (not illustrated) that receives image data from an external apparatus and performs various processing on the image data, and drives the head unit 80 based on the image data.

The system control portion color-separates the image data received from the external apparatus such as a computer, an RIP, an image scanner, a magnetic disk apparatus, or an image data transmission apparatus. The system control portion then performs division computation into an appropriate number of pixels and an appropriate number of gradations to generate image data with which the head driver 84 can drive the head unit 80 (ink jet head). Also, the system control portion controls timings of ink ejection by the head unit 80 in accordance with conveyance timings of the recording medium P by the conveyor belt 68. The ejection timings are controlled using an output from the recording medium position detection means 86 or an output signal from an encoder arranged for the conveyor belt 68 or a drive means of the conveyor belt 68.

The recording medium position detecting means 86 detects the recording medium P being fed to a position at which an ink droplet is ejected onto the medium P from the head unit 80, and known detecting means such as photo sensor can be used.

Here, when the number of the ejection portions to be controlled (the number of channels) is large as in the case where a line head is used, the head driver 84 may separate rendering to employ a known method such as resistance matrix type drive method or resistance diode matrix type drive method. Thus, it is possible to reduce the number of ICs used in the head driver 84 and suppress the size of a control circuit while lowering costs.

The ink circulating system 82 allows each ink Q to flow in the main ink flow path 30 (see FIG. 1A) of the corresponding ink jet head 80*a* of the head unit 80. For each of the ink of the four colors (C, M, Y, K), the ink circulating system 82 includes: an ink circulating device 82*a* having an ink tank, a pump, a replenishment ink tank (not illustrated), etc.; an ink supply system 82*b* for supplying the ink Q corresponding to the main ink flow path 30 of each ink jet head 80*a* of the head unit 80 from the ink tank of the ink circulating device 82*a*; and an ink recovery system 82*c* for recovering the ink Q from the main ink flow path 30 of each ink jet head 80*a* of the head unit 80 into the ink circulating device 82*a*.

An arbitrary system may be used for the ink circulating system 82 as long as this system supplies the ink Q of a color corresponding to each ink jet head 80*a* from the ink tank to the head unit 80 through the ink supply system 82*b* and recovers the ink from each ink jet head 80*a* to the ink tank through the ink recovery system 82*c* to allow ink circulation in a path for returning the ink into the corresponding color ink tank.

Each ink tank contains the ink Q of the corresponding color and the ink Q is supplied to the head unit 80 by means of a pump. Ejection of the ink from the head unit 80 lowers the concentration of ink circulating in the ink circulating system 82. Therefore, it is preferable in the ink circulating system 82 that the ink concentration be detected by an ink concentration detecting device and the ink tank be replenished as appropriate with ink from the replenishment ink tank to keep the ink concentration in a predetermined range.

Moreover, the ink tank is preferably provided with an agitator for suppressing precipitation/aggregation of solid components of the ink and an ink temperature control device for suppressing ink temperature change. When the ink temperature changes due to ambient temperature change or the like, physical properties of the ink are changed, which causes the dot diameter change. As a result, a high quality image may not be recorded with stability. A rotary blade, an ultrasonic transducer, a circulation pump, or the like may be used for the agitator.

The head unit 80, the ink tank, an ink supply line and other components are provided with a heating element such as a heater or a cooling element such as Peltier element as the ink temperature control device, and any known method, for example, a method in which control is performed with a temperature sensor like a thermostat can be used. When arranged inside the ink tank, the temperature control device is preferably arranged with the agitator such that temperature distribution is kept constant. Then, the agitator for keeping the concentration distribution in the tank constant may double as the agitator for suppressing the precipitation/aggregation of solid components of the ink.

As described above, the printer 60 includes solvent collecting means composed of the discharge fan 90 and the solvent collecting device 92. The solvent collecting means collects the carrier liquid evaporated from the ink droplets ejected on the recording medium P from the head unit 80, in particular, the carrier liquid evaporated from the recording medium P at the time of fixing the image formed of the ink droplets.

The discharge fan 90 sucks air inside the casing 61 of the printer 60 to blow the air to the solvent collecting device 92.

The solvent collecting device 92 is provided with a solvent vapor absorber. This solvent vapor absorber absorbs solvent components of gas containing solvent vapor sucked by the discharge fan 90, and exhausts the gas whose solvent has been absorbed and collected, to the outside of the casing 61 of the printer 60. Various active carbons are preferably used as the solvent vapor absorber.

While the electrostatic ink jet recording apparatus for recording a color image using the ink of four colors including C, M, Y, and K has been described, the present invention should not be construed restrictively; the apparatus may be a recording apparatus for a monochrome image or an apparatus for recording an image using an arbitrary number of other colors such as pale color ink and special color ink, for example. In such a case, the head units 80 and the ink circulating systems 82 whose number corresponds to the number of ink colors are used.

Furthermore, in the above embodiments, the ink jet recording in which the ink droplets R are ejected by positively charging the colorant particles in the ink and charging the recording medium P or the counter electrode on the rear side of the recording medium P to the negative high voltage has been described. However, the present invention is not limited to this. The ink jet image recording may be performed by negatively charging the colorant particles in the ink and charging the recording medium or the counter electrode to the positive high voltage. When the charged colored particles have the polarity opposite to that in the above-mentioned case, the applied voltage to the electrostatic attraction means, the counter electrode, the drive electrode of the ink jet head, or the like is charged to have the polarity opposite to that in the above-mentioned case.

The ink jet head and the ink jet recording apparatus according to the present invention are not limited to the type in which ink containing charged colorant component is ejected, and have no particular limitation as long as the ink jet head used is a liquid ejection head that ejects liquid containing charged particles. For example, the ink jet head can be applied not only to the electrostatic ink jet recording apparatus but also to a coating device in which charged particles are used to eject liquid droplets onto an object for coating.

The electrostatic ink jet head and the ink jet recording apparatus using the ink jet head according to the present invention have been described in detail, but the present invention is not limited to the above embodiments. It will be obvious that various modifications and changes can be made without departing from the scope of the present invention.

What is claimed is:

1. An ink jet head for ejecting ink by utilizing an electrostatic force to fly the ejected ink towards a recording medium, said ink jet head comprising:

an ejection port substrate having ejection ports bored therethrough, said ink droplet being to be ejected from said ejection ports;

a head substrate disposed at a predetermined distance from said ejection port substrate so as to define an ink flow path, which is common to said ejection ports, between said ejection port substrate and said head substrate, said ink flow path supplying said ink to said ejection ports;

channel separation walls disposed on said head substrate within said ink flow path which is common to said ejection ports, each of said channel separation walls being located in a position corresponding to each of said ejection ports; and ejection electrodes for controlling the ejection of the ink, each of said ejection electrodes being located in a position corresponding to each of said ejection ports, wherein said ejection electrodes are provided on at each of a surface of said head substrate facing said ejection port substrate and said channel separation wall, and wherein said ejection electrodes are positioned on a slightly downstream side with respect to the center of said ejection port of said ejection port substrate in a direction of said ink flow path.

2. The ink jet head according to claim 1, wherein each of said channel separation walls is protruded from a surface of said head substrate facing said ejection port substrate.

3. The ink jet head according to claim 1, wherein said channel separation walls are protrusion-like portions being protruded from a surface of said head substrate facing said ejection port substrate, and a pair of said protrusion-like portions is disposed in a position corresponding to each of said ejection ports.

4. The ink jet head according to claim 1, wherein said channel separation walls are formed nearly vertically to a surface of said head substrate facing said ejection port substrate.

5. The ink jet head according to claim 1, wherein each of said separation walls separate said ink flow path to prevent a fluid interference generated by ejection of said ink from adjacent ejection ports while allowing ink to flow around the separation walls.

6. The ink jet recording head according to claim 1, wherein a longitudinal direction of said channel separation wall is a direction of ink flow.

7. The ink jet head according to claim 1, further comprising ink guides, each disposed on said head substrate for each ejection port and passing through each ejection port, wherein said ink guides are configured such that the charged fine particle component in said ink is concentrated at the tip end portion.

8. The ink jet head according to claim 3, wherein said pair of protrusion-like portions is provided to mutually face to each other.

9. The ink jet head according to claim 3, wherein a spacing between said pair of protrusion-like portions is equal to or wider than an inside diameter of each of said ejection ports.

10. The ink jet recording head according to claim 8, wherein the ejection electrodes are disposed on mutually facing sides of the pair of protrusion-like portions.

11. The ink jet recording head according to claim 8, further comprising an ink guide corresponding to each ejection port, wherein the ink guide is disposed on the head substrate and passes through a corresponding ejection port.

12. An ink jet recording apparatus comprising:

an ink jet head for ejecting ink by utilizing an electrostatic force to fly the ejected ink towards a recording medium; and movement means for relatively moving said ink jet head and said recording medium, wherein said ink jet head includes:

an ejection port substrate having ejection ports bored therethrough, said ink being to be ejected from said ejection ports;

a head substrate disposed at a predetermined distance from said ejection port substrate so as to define an ink flow path, which is common to said ejection ports, between said ejection port substrate and said head substrate, said ink flow path supplying said ink to said ejection ports;

channel separation walls disposed on said head substrate within said ink flow path which is common to said ejection ports, each of said channel separation walls being located in a position corresponding to each of said ejection ports; and ejection electrodes for controlling the ejection of the ink, each of said ejection electrodes being located in a position corresponding to each of said ejection ports, wherein said ejection electrodes are provided on at each of a surface of said head substrate facing said ejection port substrate and said channel separation wall, and wherein said ejection electrodes are positioned on a slightly downstream side with respect to the center of said ejection port substrate in a direction of said ink flow path.

13. The ink jet recording apparatus according to claim 12, wherein each of said channel separation walls is protruded from a surface of said head substrate facing said ejection port substrate.

14. The ink jet recording apparatus according to claim 12, wherein said channel separation walls are protrusion-like portions being protruded from a surface of said head substrate facing said ejection port substrate, and a pair of said protrusion-like portions is disposed in said position corresponding to each of said ejection ports.

15. The ink jet recording apparatus according to claim 12, wherein said channel separation walls are formed nearly vertically to a surface of said head substrate facing said ejection port substrate.

16. The ink jet recording apparatus according to claim 12, wherein each of said separation walls separate said ink flow path to prevent a fluid interference generated by ejection of said ink from adjacent ejection ports while allowing ink to flow around the separation walls.

17. The ink jet recording apparatus according to claim 12, wherein a longitudinal direction of said channel separation walls is a direction of ink flow.

18. The ink jet recording apparatus according to claim 12, further comprising ink guides, each disposed on said head substrate for each ejection port and passing through each ejection port, wherein said ink guides are configured such that the charged fine particle component in said ink is concentrated at the tip end portion.

19. The ink jet recording apparatus according to claim 14, wherein the pair of protrusion-like portions is provided to mutually face to each other.

20. The ink jet head according to claim 14, wherein a spacing between said pair of protrusion-like portions is equal to or wider than an inside diameter of each of said ejection ports.

21. The ink jet recording apparatus according to claim 19, wherein the ejection electrodes are disposed on mutually facing sides of the pair of protrusion-like portions.

22. The ink jet recording apparatus according to claim 19, further comprising an ink guide corresponding to each ejection port, wherein the ink guide is disposed on the head substrate and passes through a corresponding ejection port.

* * * * *